US005535892A

United States Patent [19]

Moorhead et al.

[11] Patent Number: 5,535,892

[45] Date of Patent: Jul. 16, 1996

[54] TWO STAGE COMPOUND SPIRAL SEPARATOR AND METHOD

[75] Inventors: Robert G. Moorhead, Blairsville, Pa.; Peter O. J. Davies, Cornwall, United Kingdom

[73] Assignee: Krebs Engineers, Menlo Park, Calif.

[21] Appl. No.: 237,353

[22] Filed: May 3, 1994

[51] Int. Cl.[6] ..... B03B 5/66

[52] U.S. Cl. ..... 209/157; 209/208; 209/210; 209/725; 209/459

[58] Field of Search ..... 209/157, 208, 209/210, 725, 724, 459, 697

[56] References Cited

U.S. PATENT DOCUMENTS 2,724,498 11/1955 Beresford ..... 209/697
4,747,943 5/1988 Giffard ..... 209/459
4,795,553 1/1989 Giffard ..... 209/459
5,184,731 2/1993 Robertson et al. ..... 209/459

*Primary Examiner*—David H. Bollinger
*Attorney, Agent, or Firm*—Flehr, Hohbach, Test, Albritton & Herbert

[57] ABSTRACT

Coal spiral having a relatively short first stage helix for separating a slurry into clean coal, refuse and middlings splits, and a relatively short second stage helix for recleaning middlings split from the first stage. The first stage has only 3.25 turns, the second stage has only two turns, and a combination separator box and feed box delivers the middlings directly from the first stage to the second. The two helices are aligned coaxially, and are of opposite rotational sense to provide counter-rotation of the middlings in the two stages.

10 Claims, 6 Drawing Sheets

KREBS/SWMS COMPOUND SPIRAL

COMPARISON OF TYPICAL EXPECTED PERFORMANCE
BETWEEN A SINGLE-STAGE AND TWO-STAGE SPIROL COAL CLEANING

PERFORMANCE SUMMARY BY SIZE FRACTION

| | SINGLE-STAGE SPIROL | | TWO-STAGE COMPOUND SPIROL | |
|---|---|---|---|---|
| Size: | 1.19mm x 0.600mm | 0.600mm x 0.150mm | 1.19mm x 0.600mm | 0.600mm x 0.150mm |
| **Clean Coal Split** | | | | |
| SGS: | 1.87 | 1.96 | 2.01 | 2.12 |
| Probable Error: | 0.176 | 0.286 | 0.138 | 0.205 |
| **Refuse Split** | | | | |
| SGS: | 2.31 | 2.26 | 2.31 | 2.26 |
| Probable Error: | 0.104 | 0.194 | 0.104 | 0.194 |
| **Clean Coal Only To Product** | | | | |
| Yield (Wt%): | 77.16 | 71.77 | 78.77 | 76.96 |
| Ash (Wt%): | 6.65 | 9.56 | 7.23 | 10.60 |
| Organic Efficiency (%): | 98.88 | 92.97 | 99.67 | 98.13 |
| **CC Mids To Product** | | | | |
| Yield (Wt%): | 83.17 | 83.16 | — | — |
| Ash (Wt%): | 11.19 | 15.93 | — | — |
| Organic Efficiency (%): | 99.25 | 98.00 | — | — |
| **Refuse** | | | | |
| Yield (Wt%): | 16.83 | 16.84 | 19.38 | 20.74 |
| Ash (Wt%): | 91.22 | 90.65 | 91.18 | 90.56 |
| **Mids + Refuse** | | | | |
| Yield (Wt%): | 22.84 | 28.23 | 21.30 | 23.02 |
| Ash (Wt%): | 85.49 | 76.72 | 89.14 | 88.52 |
| **Refuse Split** | | | | |
| SGS: | 2.31 | 2.33 | — | — |
| Probable Error: | 0.103 | 0.175 | — | — |

FIG_3

| SYMBOL | SEPARATION | $D_{50}$ | PROBABLE ERROR |
|---|---|---|---|
| ■——■ | Clean Coal Split | 1.87 | 0.176 |
| +——+ | Refuse Split | 2.31 | 0.117 |
| ◇——◇ | Clean Coal + Middlings | 2.31 | 0.103 |

TYPICAL TWO-STAGE,
MIDDLINGS-RECLEAN SPIRAL
GRAVIMETRIC SEPARATION CURVES

| SYMBOL | SEPARATION | $D_{50}$ | PROBABLE ERROR |
|---|---|---|---|
| ■——■ | 1st Stage Clean Coal Split | 1.87 | 0.176 |
| +——+ | Refuse Split | 2.31 | 0.104 |
| ◇——◇ | 1st & 2nd Stage CC Splits Combined | 2.01 | 0.136 |

| SYMBOL | SEPARATION | $D_{50}$ | PROBABLE ERROR |
|---|---|---|---|
| ■——■ | Clean Coal Split | 1.96 | 0.286 |
| +——+ | Refuse Split | 2.26 | 0.194 |
| ◇——◇ | Clean Coal + Middlings | 2.33 | 0.175 |

TYPICAL TWO-STAGE,
MIDDLINGS-RECLEAN SPIRAL
GRAVIMETRIC SEPARATION CURVES

| SYMBOL | SEPARATION | $D_{50}$ | PROBABLE ERROR |
|---|---|---|---|
| ■——■ | 1st Stage Clean Coal Split | 1.96 | 0.286 |
| +——+ | Refuse Split | 2.26 | 0.194 |
| ◇——◇ | 1st & 2nd Stage CC Splits Combined | 2.12 | 0.205 |

TWO STAGE COMPOUND SPIRAL SEPARATOR AND METHOD

This invention pertains generally to coal processing and, more particularly, to a spiral separator and method for effecting gravimetric separation of coal particles.

Spiral separators, sometimes known as "coal spirals", are used in the coal industry to beneficiate raw coal to a product having a higher heating value and a lower sulfur content. The coal particles are mixed with water to form a slurry which is fed by gravity through a helical trough which is commonly referred to as a "helix". Such troughs typically make 5 turns about a vertical axis and have an outer diameter of about 915 mm, with a pitch of 419 mm per min. As the slurry travels down through the helix, particles of different specific gravities or densities are separated by the net effect of drag forces between the fluid and the particles and the coefficient of friction between the particles and the film of fluid at surface of the spiral.

Particles of greater specific gravity or density have greater coefficients of friction than particles of lesser density and follow a path of decreasing radius as they travel through the helix. Conversely, particles of lower density have lower coefficients of friction and tend to follow the path of the main water flow toward the outer perimeter of the spiral trough. The net result is that by the end of the spiral, the particles of higher density are found near the axis of the helix, and particles of decreasing densities are sequentially distributed toward the outer perimeter of the helix.

Separating vanes or "cutters" positioned toward the discharge end of the spiral direct the discharge stream into three separate output streams: a clean coal split which is taken from near the outer periphery of the helix, a refuse split which is taken from near the axis of the helix, and a middlings split which is taken from a point between the clean coal split and the refuse split.

In such separators, the middlings split presents somewhat of a problem. If it is combined with the dean coal split, the resulting product may fail to meet quality specifications such as ash, sulfur content or heating value. If the middlings split is directed to plant refuse to cure the product quality problem, an excessive amount of low density coal can be lost.

One technique heretofore employed to solve the middlings problem is to install a second stage spiral to reclean them. This permits the first stage spiral to produce an acceptable plant product and refuse stream without placing excessive refuse particles in the product stream or excessive clean coal particles in the refuse stream. When the middlings are recleaned in this manner, additional plant product is recovered in the clean coal split of the second spiral.

One disadvantage of this conventional approach is that since gravity is used to convey the middlings from the first stage to the second stage, the system occupies twice the plant height of a single stage. The spirals are typically arranged in groups of three of more spirals per stage, with a separate distributor for feeding the spirals in each stage. With 5-turn spirals having a pitch of 419 mm per turn and a separate distributor for each stage, the system requires two floors of plant space.

It is in general an object of the invention to provide a new and improved coal spiral and method.

Another object of the invention is to provide a coal spiral and method of the above character which overcome the limitations and disadvantages of the prior art.

These and other objects are achieved in accordance with the invention by providing a coal spiral having a pair of relatively short stages for effecting the primary separation and recleaning the middlings split from the first stage. In one presently preferred embodiment, the separating spiral in the first stage has a helix with only 3.25 turns, and the helix in the second stage has only two turns. The clean coal split from the first stage is directed past the second stage helix to a clean coal outlet, and the refuse split from the first stage is channeled past the second stage helix. The two helices encircle an axis in opposite directions to provide counter-rotation of the middlings in the two stages.

FIG. 3 is a table comparing the performance of a two stage compound spiral separator according to the invention with that of a single stage spiral separator.

Figure 1:
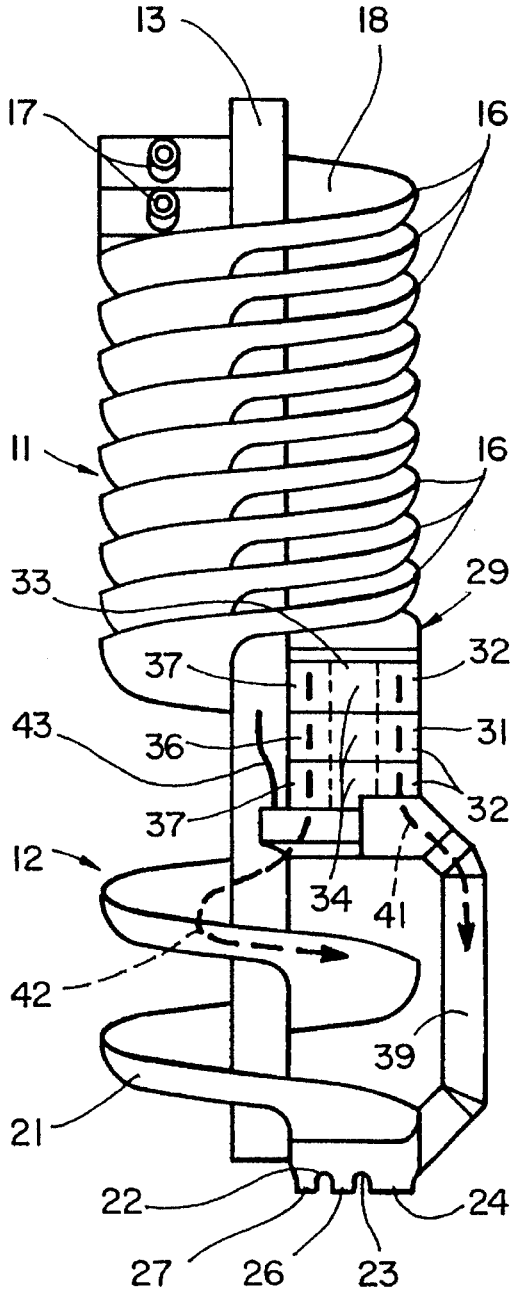
FIG. 1 is a front elevational view, somewhat schematic, of one embodiment of a two stage compound spiral coal separator incorporating the invention.
Figure 2:
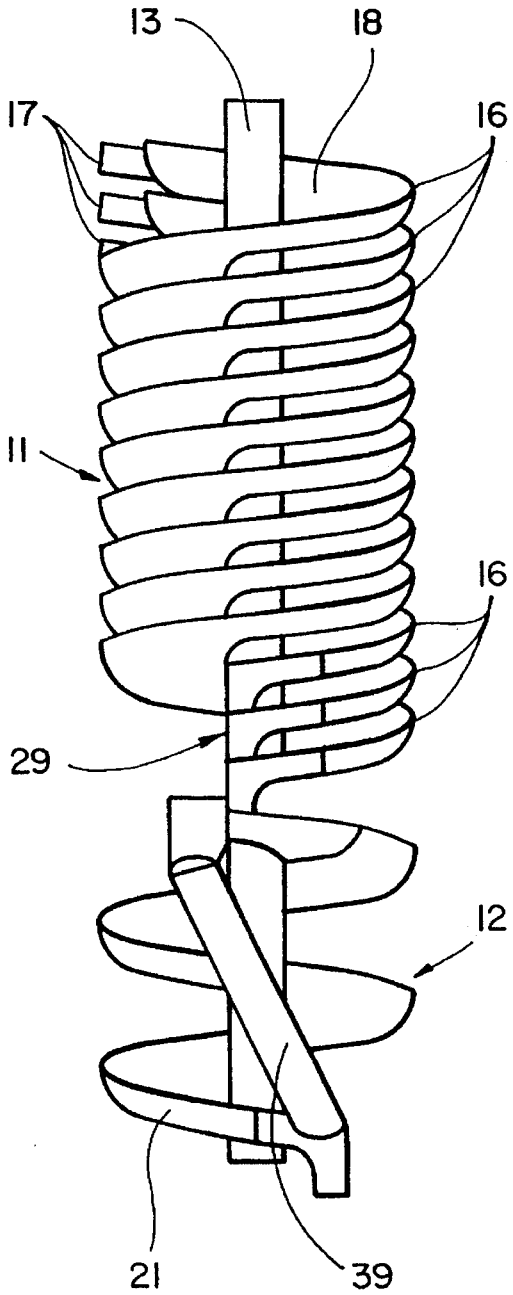
FIG. 2 is a side elevational view, also somewhat schematic, of the embodiment of FIG. 1.

As illustrated in FIG. 1, the coal separator includes a first stage 11 and a second stage 12 which are disposed about a vertically extending column 13, with the first stage positioned above the second.

The first stage has three similar helices 16 disposed coaxially and stacked together, with the turns of the three helices interposed along the axis in trifilar fashion. Each helix has an inlet 17 at its upper or inlet end, and the slurry to be processed is fed equally to the inlets by a multi-port distributor (not shown) of the type commonly used in coal spirals.

Each helix 16 has a trough 18 which makes 3.25 turns about the central axis or column, with the upper surfaces of the troughs being inclined toward the axis. These troughs are substantially shorter than the 5-turn troughs employed in conventional spirals, and this difference in length has been found to provide a significant and somewhat unexpected improvement in the performance of the separator.

Through research and experimentation with conventional 5-turn coal spirals, it has been found that the gravimetric separation phase in a coal spiral primarily occurs in the acceleration zone of the first three turns of the spiral. Moreover, it now appears that further travel in a spiral can actually have a detrimental effect on the desired gravimetric separation because once the particles exit the acceleration zone, the majority of any further particle separation which occurs is by size rather than specific gravity or density.

As in the case of 5-turn spirals, helices 16 each have an outer diameter of about 915 mm, with a pitch of 419 mm per turn. However, the overall height of the three stacked helices is substantially less than that of the 5-turn spirals of the prior art.

The second stage 12 consists of a single helical trough 21 which makes two only turns about the central axis or column. This helix has the same diameter and pitch as the helices in the first stage. At the lower end of the helix, vanes 22, 23 extend longitudinally of the trough and separate the output into a clean coal outlet 24, a middlings outlet 26 and a refuse outlet 27.

A combined separator and feed box 29 interconnects the two stages and performs the functions of a product splitter for the first stage and a feed box for the second stage. The box has a clean coal chamber 31 in communication with the clean coal outlets 32 of the helices in the first stage, a middlings chamber 33 in communication with the middlings outlets 34, and a refuse chamber 36 in communication with the refuse outlets 37.

A bypass pipe 39 extends between dean coal chamber 31 and the lower end of helix 21 and feeds the clean coal split 41 from the first stage into the second stage at a point just above clean coal outlet 24. The pipe connects to an opening in the outer wall of the trough adjacent to the outlet, thereby effectively bypassing the helix in the second stage.

The middlings chamber 33 serves as a mixing/fee box for the slurry which is fed to the second stage. It communicates with the upper or input end of helix 21 and delivers the middlings split from the first stage to the central portion of the trough in the second stage helix.

The refuse chamber 36 also communicates with the upper or input end of helix 21, but in a region closer to the axis than where the middlings are introduced. The inner portion of helix 21 serves as a refuse channel which carries the refuse stream 42 from the first stage through the second stage in a region where it effectively bypasses the separation zone of the second stage and does not interfere with the separation or cleaning of the middlings.

Column 13 is hollow, and repulping water 43 is supplied to the second stage mixing/feed box through the column from above. Being carried through the first stage within the column, the repulping water supply does not interfere with access to the first stage.

The helices in the two stages are of opposite rotational sense in that the turns of the helices 16 in the first stage wind down in a clockwise direction, whereas the rams of helix 21 in the second stage wind down in a counter-clockwise direction, as viewed from above. This provides a counter-rotation of the middlings in the two stages, and the redirection of the slurry is useful for mixing purposes. In addition, the counter-rotation of the two stages reduces the overall height of the system in comparison with what it would be if the helices in the two stages were all of the same rotational sense.

The overall height of the system with the two stages and the separator/feed box is on the order of 3200–3300 mm, which is about the same as the height of single stage of three 5-turn spirals of similar pitch and conventional design. In contrast, a two stage system employing 5-turn helices in both stages would stand approximately 6800–6900 mm high, over twice the height of the two stage system of the invention.

Operation and use of the separator, and therein the method of the invention, are as follows. Coal particles having a size on the order of 1.19 mm×0.150 mm are mixed with water to form a slurry containing about 30–45 percent solids on a weight to weight basis. This slurry is fed to the upper ends of the helices 16 in the first stage and allowed to flow by gravity through the helices.

As the slurry travels down through the helices, the particles are distributed across the troughs in accordance with their specific gravities or densities. The refuse particles which have greater specific gravities than coal particles follow a path of decreasing radius, the coal particles are distributed toward the outer perimeter of the troughs, and the middlings collect toward the centers of the troughs.

At the output end of the first stage, the separator/feed box 29 delivers the clean coal split to pipe 39 which carries it past the second stage helix to clean coal outlet 24. The refuse stream from the first stage is delivered to the refuse channel toward the inner radius of helix 21 and flows through the second stage to refuse outlet 26. The middlings split from the first stage is mixed with repulping water in the middlings chamber of the separator/feed box, and fed by gravity through the second stage helix. Here, a further gravimetric separation occurs, with the lighter coal particles being distributed toward the outside of the trough and delivered to clean coal outlet 24, the heavier refuse material following the inner channel to refuse outlet 26, and the remaining middlings following a central path and being delivered to middlings outlet 27.

A comparative performance summary for a single stage spiral separator and the two stage compound spiral separator of the invention is given in the table of FIG. 3. In this table, data is given for two typical product sizes, 1.19 mm×0.600 mm particles and 0.600×0.150 mm particles.

As shown in the table, with a single stage spiral and a 1.19 mm×0.600 product size, the product contains 6.65 percent ash and has a 77.16 percent yield if only the clean coal split is used as plant product, and contains 11.19 percent ash with a 83.17 percent yield if the middlings split is combined with the clean coal. With a 0.600×0.150 product size, the product contains 9.95 percent ash and has a 71.77 yield for the clean coal alone, and 15.93 percent ash and a 83.16 percent yield if the middlings are included.

The differences in the ash content (4.54 and 6.38 percent) for the two product sizes with and without the middlings are significant. Furthermore, if the product quality specification was such that only the clean coal splits could be directed to plant product, the system could be operated with organic efficiencies of 98.9 and 93.0 percent for the two particle sizes.

In contrast, a two-stage compound spiral produces a 1.19 mm×0.600 mm product with 7.23 percent ash and a 78.77 percent yield, and a 0.600 mm×0.150 mm product with 10.60 percent ash and a 76.98 percent yield. The organic efficiencies for the two products are 99.7 and 98.1 percent, respectively.

Comparison of this data indicates that the two stage compound spiral of the invention provides an improvement in organic efficiency of between 0.8 and 5 percent, depending upon particle size, with only modest increases in ash content. It also shows that the greatest improvement in cleaning performance occurs on the finer size fractions.

FIGS. 4–7 further illustrate the improvement in performance achieved by the two stage compound spiral separator of the invention.

Figure 4:
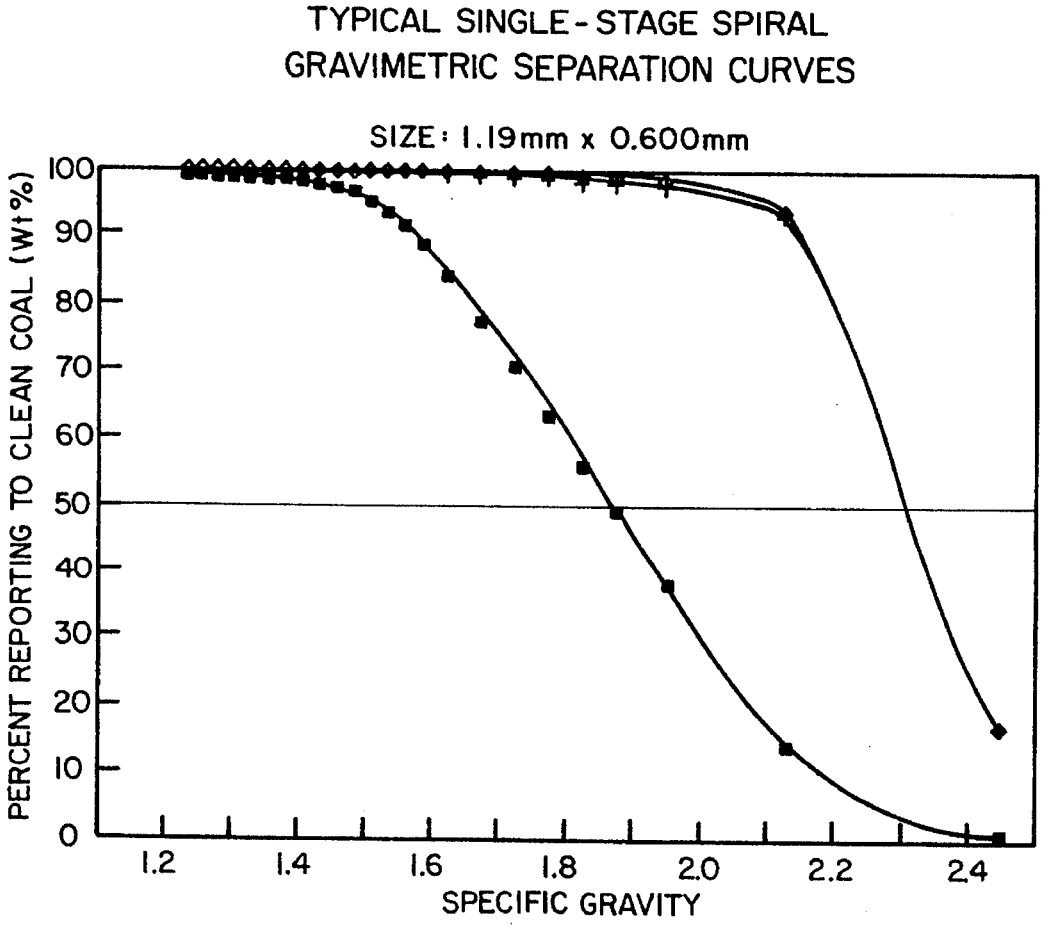
FIGS. 4–7 are separation curves for single and two stage spiral gravimetric separators.
Figure 5:
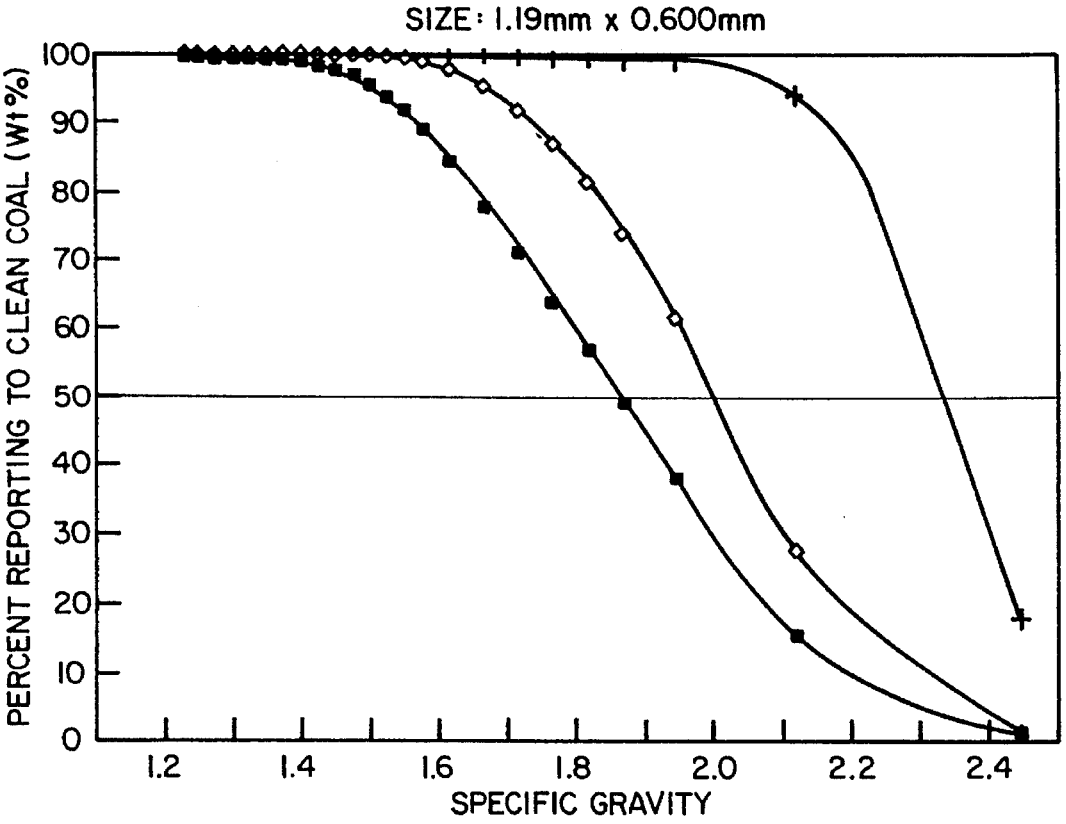

FIGS. 4 and 5 show typical spiral gravimetric separation curves (partition curves) for both single and two stage spiral separators and particle sizes of 1.190 mm×0.600 mm. Most notable improvements in performance can be seen when comparing the clean coal split achieved by the two units. The single stage unit achieves a clean coal split at a $D_{50}$ of 1.87 SG with a probable error of 0.176, while the two stage compound spiral achieves a dean coal split at a $D_{50}$ of 2.01 SG, with a probable error 0.138. Thus, the two stage compound spiral produces a slightly higher $D_{50}$ (0.14 SG units) but at a significantly lower probable error (0.038 less) than the single stage unit. In addition, the two stage compound spiral produces a clean coal split at a lower $D_{50}$ (2.01 SG) than the single stage unit (2.31 SG) when both the dean coal and the middlings splits are included in the plant product.

Figure 6:
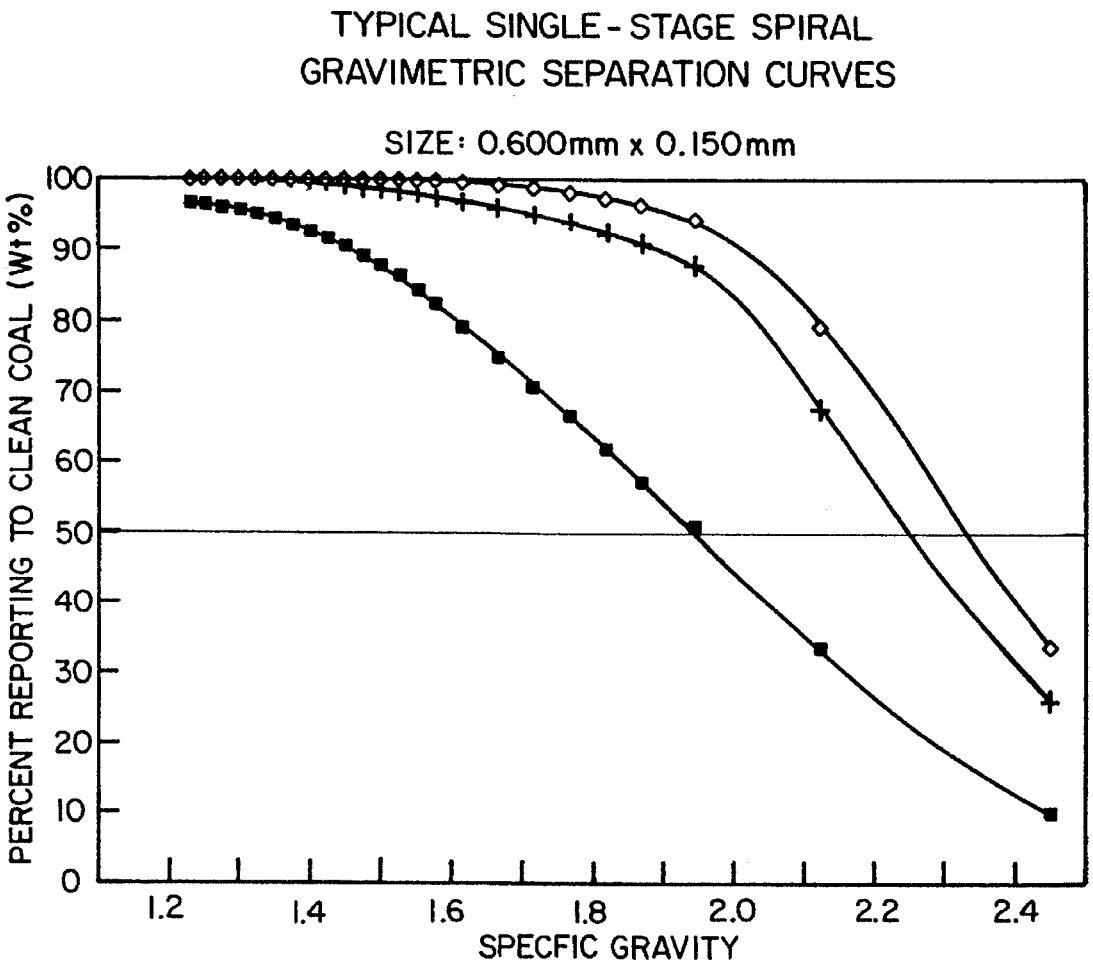
Figure 7:
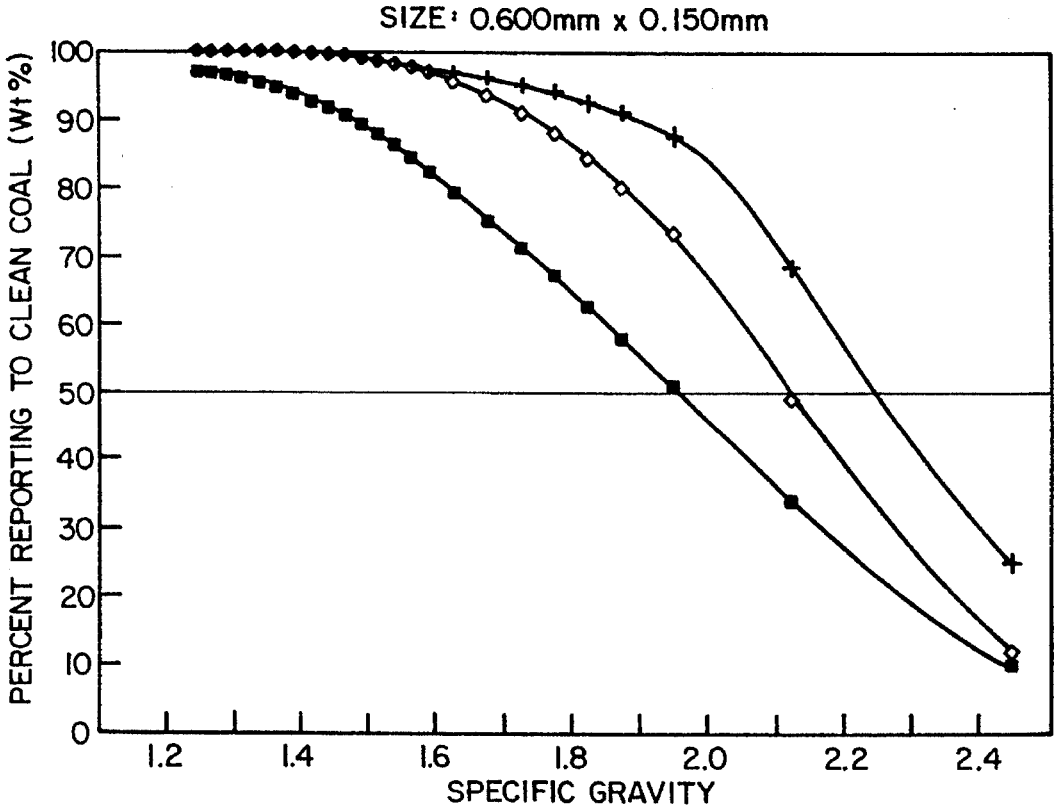

FIGS. 6 and 7 show similar curves for particle sizes of 0.600 mm×0.150 mm. Again, the greatest improvements in performance can be seen when comparing the clean coal splits of the single stage and two stage spirals. As shown in these figures, the single stage unit achieves a dean coal split at a $D_{50}$ of 1.96 SG and a probable error of 0.286, whereas the two stage compound spiral produces a clean coal split at a $D_{50}$ of 2.12 SG with a probable error of 0.205. One again, the two stage compound spiral produces a clean coal split at a slightly higher $D_{59}$ (2.12 SG) than the single stage unit (1.96 SG), but with a significantly lower probable error (0.081 lower).

These partition curve comparisons give an indication of the improvement in gravimetric separation achieved by the invention. This, in combination with the compactness of the system, provides a significant advancement in the art of coal beneficiation.

It is apparent from the foregoing that a new and improved coal separator and method have been provided. While only certain presently preferred embodiments have been described in detail, as will be apparent to those familiar with the art, certain changes and modifications can be made without departing from the scope of the invention as defined by the following claims.

We claim:

1. In apparatus for separating coal particles:

a first stage separating spiral having an inlet for receiving a slurry containing coal particles, and a helix having only about 3.25 turns encircling an axis for separating the slurry into a clean coal split, a middlings split and a refuse split;

a second stage separating spiral disposed coaxially of the first stage spiral and having a helix with less than five turns encircling the axis for cleaning the middlings split from the first stage;

means for feeding the middlings split from the first stage to the helix in the second stage;

means for directing the clean coal split from the first stage past the second stage spiral to a dean coal outlet; and a refuse channel for carrying the refuse split from the first stage past the second stage helix.

2. The apparatus of claim 1 wherein the helix in the second stage has only about two turns encircling the axis.

3. The apparatus of claim 1 wherein the rams in the first stage helix and the turns in the second stage helix encircle the axis in opposite directions.

4. The apparatus of claim 1 including means extending along the axis for supplying repulping water to the helix in the second stage.

5. In a method of separating coal particles, the steps of:

feeding a slurry containing coal particles to a first stage separating spiral having only about 3.25 turns encircling an axis to separate the slurry into a clean coal split, a middlings split and a refuse split;

feeding the middlings split from the first stage to a second stage separating spiral having a helix with a plurality of turns encircling the axis to clean the middlings split from the first stage;

directing the clean coal split from the first stage past the second stage spiral to a clean coal outlet; and channeling the refuse split from the first stage past the second stage helix.

6. The method of claim 5 wherein the middlings split from the first stage passes around only about two turns in the second stage helix.

7. The method of claim 5 wherein the slurry and the middlings split are fed around the axis in opposite directions in the first and second stage spirals.

8. The method of claim 5 including the step of supplying repulping water along the axis to the helix in the second stage.

9. In apparatus for separating coal particles:

a first spiral having approximately 3.25 turns encircling an axis in a first direction between input and output ends thereof, a second spiral having approximately two turns encircling the axis between input and output ends thereof in a direction opposite to the first direction, means for feeding a slurry containing coal particles to the input end of the first spiral for separation into a product split, a refuse split and a middlings split, and a combined separation and feed box connected between the output end of the first spiral and the input end of the second spiral for delivering the middlings split to the input of the second spiral.

10. The apparatus of claim 9 including means for supplying repulping water along the axis to the input end of the second spiral.

* * * * *